United States Patent [19]

Inukai et al.

[11] Patent Number: 4,721,887

[45] Date of Patent: Jan. 26, 1988

[54] METAL HALIDE ARC LAMP HAVING PINCH SEAL WITH ELONGATED SPACE

[75] Inventors: Shinji Inukai, Yokohama; Kazuo Honda, Zushi, both of Japan

[73] Assignee: Kabushiki Kaisha Toshiba, Kawasaki, Japan

[21] Appl. No.: 869,333

[22] Filed: Jun. 2, 1986

[30] Foreign Application Priority Data

Jun. 14, 1985 [JP] Japan ..... 60-88814[U]

[51] Int. Cl.[4] ..... H01J 61/30; H01J 61/36

[52] U.S. Cl. ..... 313/623; 313/573; 313/634

[58] Field of Search ..... 313/573, 623, 634

[56] References Cited

U.S. PATENT DOCUMENTS 4,171,500 10/1979 Van Lieshout ..... 313/623 X 4,282,395 8/1981 Hagemann ..... 313/623 X

*Primary Examiner*—David K. Moore

*Assistant Examiner*—K. Wieder

*Attorney, Agent, or Firm*—Oblon, Fisher, Spivak, McClelland & Maier

[57] ABSTRACT

A metal halide arc lamp includes a quartz arc tube having a pair of electrode shaft therein. The quartz arc tube which encloses a fill including mercury and metal halide materials is composed of a hollow illuminating portion and a pair of squeezed portions which have an individual elongated space, extending along the electrode shaft, the minimum value of the width, in the direction perpendicular to the electrode shaft, of which is controlled within specific values in connection with a diameter of the electrode shaft to reduce a probability of crack occurrence in the squeezed portion by a pressure produced when the fill is vapored rapidly in the elongated space of the squeezed portion.

8 Claims, 3 Drawing Figures

METAL HALIDE ARC LAMP HAVING PINCH SEAL WITH ELONGATED SPACE

BACKGROUND OF THE INVENTION

1. Field of the Invention

The present invention relates to, in general, a high pressure metal vapor arc lamp. In particular, the invention relates to a metal halide arc lamp containing a fill including mercury and metal halide materials such as NaI, $ScI_3$, etc.

2. Description of the Prior Art

In general, metal halide arc lamps have a quartz arc tube enclosing a pair of electrode shafts therein. Each of electrode shafts faces each other in each side inside a tube, connecting with an individual external lead through a metalfoil. The metalfoil is made of high-melt point metals such as molybdenum. The each end of tube is squeezed to form a flat surface. The arc tube is filled with a starting rare gas such as argon, mercury, and a metal halide material such as NaI, $ScI_3$.

To enclose a pair of main electrodes consisting of the electrode shafts and the metalfoils in an arc tube, the squeezed parts are formed by using the following procedures. Each of the main electrodes is faced each other along the elongated axis of the arc tube in each end of the arc tube. The each end is softened by heating and the each opposite side is squeezed with a pair of pinchers.

By using this method, a gap is created around the electrode shaft because the diameter of electrode shaft is large. The gap is created lengthwise along the electrode shaft. The width of gap extends to the breadth direction of the squeezed part, or to the direction perpendicular to the elongated axis of the arc tube. This gap is required to absorb a difference in the thermal expansion coefficient between the metal of electrode and the squeezed glass.

In a metal halide lamp with the above-described constructions, the metal halide enclosed in the arc tube is entered in the gap. When the lamp is energized, the temperature of the electrode shaft rises and the halide evaporates quickly. Evaporated halide provides high internal pressures to the narrow gap. When the compression strength of squeezed glass part is lower than an internal pressure, a shelly crack is created in the squeezed part. For some arc tubes, this crack caused filler in the arc tube to be leaked, or the arc tube to be damaged. In addition, since the thermal expansion coefficient of the electrode shaft is different from that of the squeezed part of tube, when an arc lamp was turned on and off, a crack was created in the glass of the squeezed part.

The result of observation and testing conducted by the investors shows that there is a trend toward smaller gap of a squeezed part with increasing leak and defect in arc tubes. The other result shows that larger gap lowers the initial pressure strength of the squeezed part of arc tube.

SUMMARY OF THE INVENTION

It is an object of the present invention to provide an improved metal halide arc lamp which is of a long life.

To accomplish the above-described object, the present invention provides a metal halide arc lamp comprising a quartz arc tube having individual squeezed portions at both ends thereof. Each squeezed portion defines an elongated space, extending along an electrode arranged therein, the minimum value (Lmin) of the width, in the direction perpendicular to the electrode, of which satisfies:

$$0.1\ \text{mm} < L_{min} < 0.3\ \text{mm}$$

when the diameter (D) of the electrode is 0.4 mm and less, or $$(1/6)D + (1/30) < L_{min} < (1/6)D + (7/30)$$

when the diameter (D) of the electrode is more than 0.4 mm, whereby enchansing the pressure resistance of each squeezed portion of the arc tube.

BRIEF DESCRIPTION OF THE DRAWINGS

The present invention will be better understood with reference to the accompanying drawings, wherein like reference numerals throughout the various Figures denote like structure elements and wherein.

DETAIL DESCRIPTION OF THE PREFERRED EMBODIMENT

Figure 1:
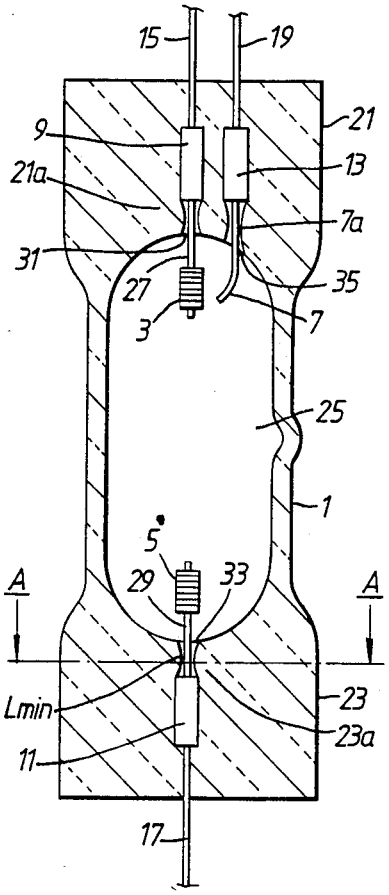
FIG. 1 shows a vertical longitudinal sectional view of an embodiment of the present invention.

Refering to the accompanying drawings, an embodiment of this invention will be described. FIG. 1 shows a vertical section of an arc tube of metal halide arc lamp with a 100 W rating. An arc tube 1 has a quartz envelope containing a fill of a proper amount of starting rare gas, such as argon, mercury and metal halide materials, e.g. NaI and $ScI_3$. NaI and $ScI_3$ are able to improve characteristics of visible spectrum emitted from mercury. NaI and Sc, however, quickly react on quartz. To prevent these metals from being reacted, Na and Sc are individually combined with iodine to be halogenated before they are enclosed in arc tube 1.

In addition to NaI and $ScI_3$, rare earth metals such as Dy (Dysprosium) and Tm (Thulium) are able to be used as a filler. These materials are individually used, or used togather with one another. In this case, the rare earth metals are halogenated and filled in the arc tube as described above.

A pair of main electrodes 3 and 5, made of metal such as tungsten, faces each other in each end of arc tube 1. An auxiliary electrode 7 is arrenged close to main electrode 3. Main electrodes 3 and 5, and auxiliary electrode 7 are connected to external leads 15, 17 and 19 through metal foils 9, 10 and 13 respectively. Metal foils 9, 10 and 13 are made of a metal with a high melt point such as molybdenum.

Both ends of arc tube 1 are heated and compressed to be formed squeezed parts 21 and 23 respectively. As the result, arc tube 1 has a hollow luminous area 25 between squeezed parts 21 and 23.

Main electrodes 3 and 5 have electrode shafts 27 and 29, respectively, connected to metal foils 9 and 11 respectively. Main electrodes 3 and 5 are arranged opposite to one another in luminous area 25. Electrode shafts 27 and 29 are arranged in squeezed parts 21 and 23 respectively. When squeezed part 21 is formed, a gap 31 is created between electrode shaft 27 and glass material 21*a* of squeezed part 21. Gap 31 extends along electrode shaft 27, and expands breadthwise to electrode shaft 27. In the same way, a gap 33 is created between electrode shaft 29 and glass material 23*a* of squeezed part 23, and a gap 35 between a base portion 7*a* of auxiliary electrode 7 and glass material 21*a* of squeezed part 21.

Figure 2:
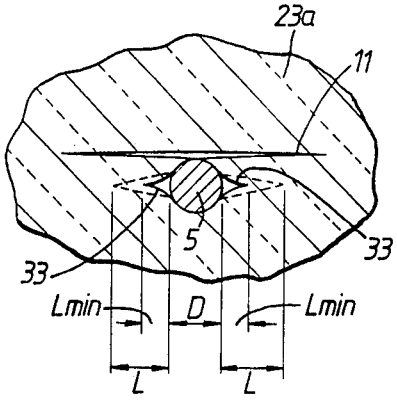
FIG. 2 shows an enlarged sectional view taken in the direction of the arrows along the line A—A′ of FIG. 1.

Refering to FIG. 2, the configuration of gaps 31, 33 and 35 will be described. Because gaps 31, 33 and 35 have the same configuration respectively, FIG. 2 shows the section crossing along line A—A' in FIG. 1, which illustrates squeezed part 23 of arc tube 1. The width (L) of gap 33 extends breadthwise to squeezed part 23 or to the direction perpendicular to the compressed direction of squeezed part 23. As can be seen in FIG. 1, the width (L) of gap 33 defined by electrode shaft 29 and glass material 23*a* of squeezed part 23 is formed such that it becomes gradually wider from the middle portion of the gap toward its both ends. In this embodiment, the diameter of electrode shaft 29 is set to 0.4 mm, and the minimum value (Lmin) of the width of gap 33 in the squeezed part 23 is set to 0.2 mm. Normally, an arc tube is enclosed in an external tube (not illustrated in figures) to be formed as a lamp.

When a lamp with the construction described above is installed in a vertical position with squeezed part 23 faced downward, metal halide and mercury filled in arc tube 1 are accumulated in luminous area 25 of arc tube 1. Then metal halide and mercury are entered into gap 33 between electrode shaft 29 and squeezed part glass material 23*a*. When the lamp is energized, quick temperature rise of electrode shaft 29 causes the metal halide and mercury to be evaporated rapidly. Therefore, the pressure caused by evaporation of the metal halide and mercury is applied to squeezed part glass 23*a* defining gap 33. Since the minimum value (Lmin) of width (L) of gap 33 is set to as wide as 0.2 mm, the applied pressure is moderated. This effect prevents squeezed glass 23*a* from being cracked. In addition, gap 33 which has a sufficient width absorbes a difference in thermal expansion coefficient between electrode shaft 29 and squeezed glass 23*a*. This provides advantage that occurrence of cracks in the glass of squeezed part 23 caused by temperature changes occurring when the lamp is turned on and off is prevented.

The width (L) of gaps 31, 33, and 35 can be limited to a specified value by changing the shape of pincher or the rate of application of pressure used for manufacturing a lamp.

When a lamp is turned on in the vertical position as above-described embodiment, no filler is entered into gaps 31 and 35 produced in squeezed part 21 located at the upper part of arc tube 1, or rare amount of filler is entered. For that reason, the minimum value (Lmin) of the width (L) of gap 31 is not required to be considered. However, if the squeezed part to be located in the lower position cannot be predicted, the width (L) of gaps 31 and 33 produced in squeezed parts 21 and 23 is required to be limited to the minimum value (Lmin) as described above. For gap 35 created in the squeezed part 21, such consideration is not required even if auxiliary electrode 7 is located in the lower position. The reason; 1: A large current does not flow in an auxiliary electrode 7. 2: Current flows in auxiliary electrode 7 for an extreme, short duration until arcing starts between main electrodes 3 and 5. For that reason, temperature of auxiliary electrode 7 rises extremely slow unlike temperatures of main electrodes 3 and 5. Therefore, since the filler entered in gap 35 evaporates slowly, squeezed glass 21*a* is not damaged.

The following table shows the comparison between the minimum values (Lmin) of width (L) of gap 33 produced between electrode shaft 29 located in the lower position and squeezed glass 23*a* and a number of lamps crack is occurred. Lamps of the same type as that in the embodiment described above are used as the sample. A total amount of the sample is 20.

TABLE

| Lmin (mm) | 0.05 | 0.07 | 0.1 | 0.2 | 0.3 | 0.4 | 0.5 |
|---|---|---|---|---|---|---|---|
| Number of lamps crack is occurred after 3000 hours of lighting | 7 | 4 | 1 | 0 | 0 | 0 | 0 |
| Average value of initial pressure resistance (atm.) | 55 | 55 | 53 | 50 | 47 | 35 | 30 |
| Deviation of initial pressure resistance (standard deviation $\sigma$) (atm.) | 7 | 8 | 8 | 7 | 9 | 8 | 7 |

This result shows that a number of lamps crack is occurred is extremely small (the probability of lamp cracking is 1/20) when the minimum value (Lmin) is 0.1 mm. Cracking of this level is not associated with leakage or failure of arc tube 1. In contrast, when the minimum value (Lmin) is smaller, specifically 0.07 or 0.05 mm, more lamps are cracked, and some of these cracks are large enough to cause arc tubes to be cracked or damaged. Evaluations of these data indicate that the minimum value (Lmin) should be at least 0.1 mm. In contrast to a number of lamps crack is occurred, the initial pressure resistance of a lamp can be improved with reducing the minimum value (Lmin) of gap 33. Assuming that the population of initial pressure resistance is normally distributed, if the limited value is represented as the average value$-3\sigma$, the lower limit is 11 atmospheres when the minimum value (Lmin) is 0.4 mm. The internal pressure of arc tube 1 is about 10 atmospheres when a 100 w rating metal halide arc lamp is activated, and there is some fluctuation of this internal pressure during manufacturing. In consideration of these facts, it can be concluded that the minimum value (Lmin) is set to less than 0.3 mm rather than 0.4 mm. This indicates that it is desirable that the minimum value (Lmin) is from 0.1 mm to 0.3 mm to meet both the crack and the initial pressure resistance characteristics.

Figure 3:
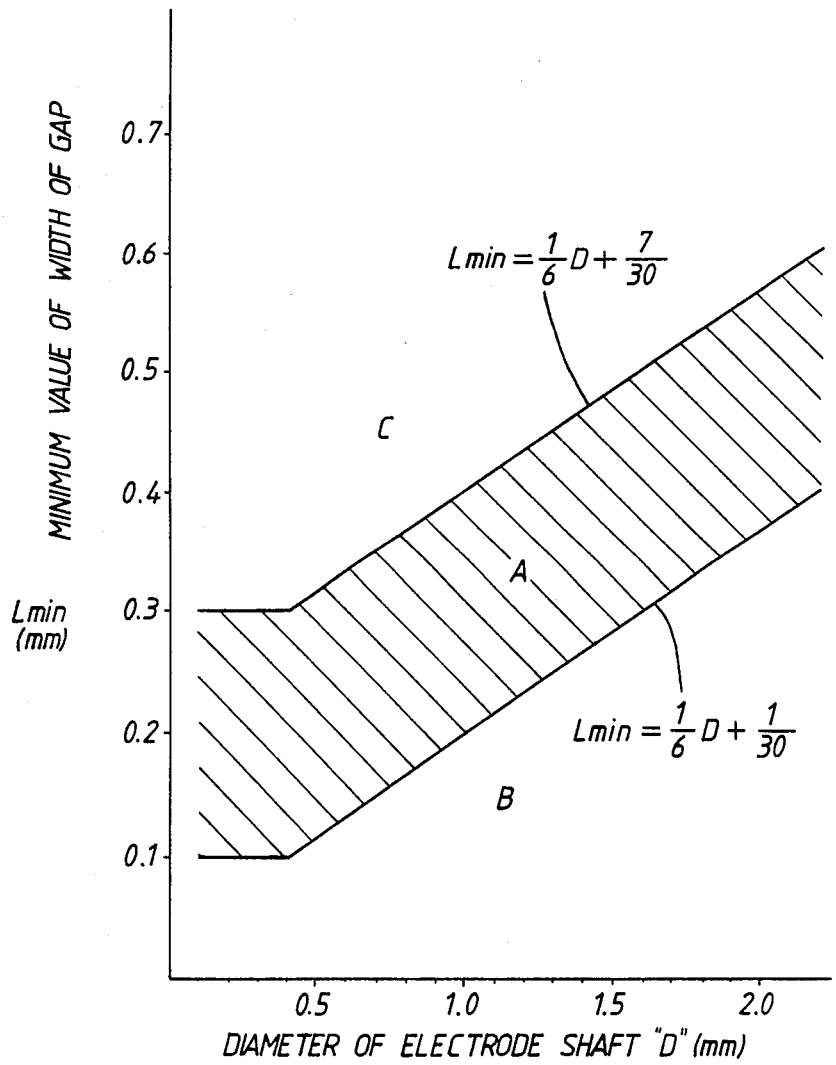
FIG. 3 shows a graph illustrating the characteristic of an arc tube obtained by varying the relationship between the diameter of an electrode and the width of a space created in a squeezed portion of the arc tube.

FIG. 3 shows the results of the tests carried out on lamps with various different main electrode diameters D and lamp inputs characteristics, in a similar way to the tests described above. The region A represented by diagonal line in FIG. 3 is the region where the probability of crack occurence is low during the life of the arc lamp, and where a squeezed part of an arc tube with initial pressure resistance enough for practical use can be obtained. The region B represents the area where the probability of crack creating during the service life is high. The region C represents the area where the initial pressure resistance is low.

FIG. 3 shows the following correlation.

When the diameter (D) of an electrode shaft is 0.4 mm or less, the minimum value (Lmin) of width of the gap should be;

$$0.1\ \text{mm} < \text{Lmin} < 0.3\ \text{mm}$$

It is undesirable that the minimum value (Lmin) is 0.1 mm or less, because the probability of a lamp crack is created is high. It is undesirable that the minimum value (Lmin) exceeds 0.3 mm, because the initial pressure resistance is low.

When the diameter (D) of an electrode shaft is more than 0.4 mm, the minimum value (Lmin) should be;

$$(1/6)D+(1/30)<Lmin<(1/6)D+(7/30)$$

If $Lmin<(1/6)D+(1/30)$,
the probability of a lamp crack is created is high.

If $Lmin<(1/6)D+(7/30)$, the initial pressure resistance is low.

In summary, it will be seen that the present invention overcomes the disadvantage of the prior art and provides an improved metal halide arc lamp in which the probability of a lamp crack is created during the service life thereof is low, and a squeezed part thereof with initial pressure resistance enough to practical use is obtained.

What is claimed is:

1. A metal halide arc lamp comprising:

a quartz arc tube containing a fill including mercury and metal halide material;

a first electrode, arranged at one of the ends of said quartz arc tube, which extends along the elongated axis of said quartz arc tube;

a second electrode, arranged at the other end of said quartz arc tube, which extends along the elongated axis of said quartz arc tube;

a first squeezed portion, formed at one end of said quartz arc tube, which seals the one end of said quartz arc tube and supports said first electrode, said first squeezed portion including a first elongated space, which extends along said first electrode, the minimum value ($L_1$) of the width, in the direction perpendicular to said first electrode, of which satisfies:

$$0.1\ mm<L_1<0.3\ mm$$

when the diameter ($D_1$) of said first electrode is 0.4 mm or less;

a second squeezed portion, formed at the other end of said quartz arc tube, which seals the other end of said quartz arc tube and supports said second electrode.

2. A metal halide arc lamp comprising:

a quartz arc tube containing a fill including mercury and metal halide material;

a first electrode, arranged at one of the ends of said quartz arc tube, which extends along the elongated axis of said quartz arc tube;

a second electrode, arranged at the other end of said quartz arc tube, which extends along the elongated axis of said quartz arc tube;

a first squeezed portion, formed at one end of said quartz arc tube, which seals the one end of said quartz arc tube and supports said first electrode, said first squeezed portion including a first elongated space, which extends along said first electrode, the minimum value ($L_1$) of the width, in the direction perpendicular to said first electrode, of which satisfies;

$$(1/6)D_1+(1/30)<L_1<(1/6)D_1+(7/30)$$

when the diameter ($D_1$) of said first electrode is more than 0.4 mm; and a second squeezed portion, formed at the other end of said quartz arc tube, which seals the other end of said quartz arc tube and supports said second electrode.

3. The metal halide arc lamp according to any one of claims 1 or 2, wherein said second squeezed portion includes a second elongated space, which extends along said second electrode, the minimum value ($L_2$) of the width, in the direction perpendicular to said second electrode, of which satisfies;

$$0.1\ mm<L_2<0.3\ mm$$

when the diameter ($D_2$) of said second electrode is 0.4 mm and less.

4. The metal halide arc lamp according to claim 3, wherein said first electrode includes a first main electrode element which is formed at one end thereof and disposed in said quartz arc tube, and a first thin metal element which is electically connected to the other end thereof and disposed within said first squeezed portion.

5. The metal halide arc lamp according to claim 4, wherein said second electrode includes a second main electrode element which is formed at one end thereof and arranged opposite to said first main electrode element in said quartz arc tube, and a second thin metal element which is electrically connected to the other end thereof and disposed within said second squeezed portion.

6. The metal halide arc lamp according to any one of claim 1 or 2, wherein said first elongated space is defined by the glass material of said first squeezed portion and said first electrode such that it becomes gradually wider in width from the middle portion thereof toward its both ends.

7. The metal halide arc lamp according to claim 3, wherein said second elongated space is defined by the glass material of said second squeezed portion and said second electrode such that it becomes gradually wider in width from the middle portion thereof toward its both ends.

8. The metal halide arc lamp according to any one of claims 1 or 2, wherein said second squeezed portion includes a second elongated space, which extends along said second electrode, the minimum value ($L_2$) of the width, in the direction perpendicular to said second electrode, of which satisfies;

$$(1/6)D_2+(1/30)<L_2<(1/6)D_2+(7/30)$$

when the diameter ($D_2$) of said second electrode is more than 0.4 mm.

* * * * *